US006986615B2

(12) United States Patent
Moore et al.

(10) Patent No.: US 6,986,615 B2
(45) Date of Patent: Jan. 17, 2006

(54) BACKLASH REDUCTION

(75) Inventors: Steven R. Moore, Rochester, NY (US); Eric A. Merz, Palmyra, NY (US)

(73) Assignee: Xerox Corporation, Stamford, CT (US)

( * ) Notice: Subject to any disclaimer, the term of this patent is extended or adjusted under 35 U.S.C. 154(b) by 704 days.

(21) Appl. No.: 09/918,760

(22) Filed: Aug. 1, 2001

(65) Prior Publication Data

US 2003/0026640 A1 Feb. 6, 2003

(51) Int. Cl.

| | |
|---|---|
| ***B41J 11/58*** | (2006.01) |
| ***B41J 11/42*** | (2006.01) |
| ***B65H 5/34*** | (2006.01) |

(52) U.S. Cl. ..... 400/625; 400/582; 271/270

(58) Field of Classification Search ..... 400/624, 400/625, 636, 578, 271, 226, 582, 593, 608.4, 400/621, 636.2, 629, 630, 637; 271/10.05, 271/227, 242, 270, 258.01; 101/116, 118, 101/216, 226, 232

See application file for complete search history.

(56) References Cited

U.S. PATENT DOCUMENTS

| | | | | |
|---|---|---|---|---|
| 4,519,700 | A * | 5/1985 | Barker et al. | 399/394 |
| 5,149,217 | A * | 9/1992 | Narita | 400/608.4 |
| 5,961,224 | A * | 10/1999 | Baitz et al. | 400/56 |
| 6,312,177 | B1 * | 11/2001 | Nureki | 400/578 |
| 6,520,701 | B2 * | 2/2003 | Kaya | 400/621 |

* cited by examiner

*Primary Examiner*—Edward Lefkowitz
*Assistant Examiner*—Hoai-An D. Nguyen
(74) *Attorney, Agent, or Firm*—Oliff & Berridge, PLC

(57) ABSTRACT

Backlash is reduced by stopping substrate short of a printing position, then slowly advancing the drive system to move the substrate to the printing position. Where a stepper motor drives a driven roller via a gear train, the stepper motor stops the substrate a predetermined number of steps shy of the printing position. The stepper motor is then advanced by the predetermined number of steps, taking up backlash and moving the substrate to the printing position.

17 Claims, 4 Drawing Sheets

BACKLASH REDUCTION

BACKGROUND OF INVENTION

Paper advance error ("stitch" error) in a TIJ printer can result from a combination of drive train backlash together with coasting of the driven transport as the drives decelerate. This IP proposes a two-part paper advance profile to remedy this problem. The paper is advanced short of the final intended position. The final paper advance is made as a series of discrete steps which take up any backlash that may have occurred during the first advance.

Most low-cost TIJ printers advance paper incrementally through the print zone, such as by using a stepper motor or a position-controlled servo motor driving a shaft via a geartrain. Because the geartrain is designed for low cost manufacture, there is inevitably accumulated backlash in the drive train. This backlash can be a source of error in precision paper advances between carriage scans. Typical precision requirements are single standard of deviation errors of 20 $\mu$m for a paper advance of about 10 mm. Any backlash in the system can contribute an error if the motor deceleration occurs more rapidly than the driven roll deceleration. This is possible because the driven rolls are large diameter with significant inertia and low frictional drag. In this event, the load (driven roll) will "coast" through the geartrain backlash and stop at some indeterminate position.

SUMMARY OF INVENTION

Embodiments substantially reduce this error source by advancing the substrate short of the next printing position by a predetermined amount, such as N motor steps or encoder units. Embodiments then more slowly advances the substrate in increments to the next printing position, such as by advancing a stepper motor by N additional steps or by advancing a position-controlled servo motor by N encoder units. The value for N can be predetermined to be greater than the total possible backlash error in the drive train. As a result, the driven roll can be in some indeterminate position within the range of backlash error. If the driven roll has not coasted ahead at all, then it will be advanced by N increments and will be parked in the correct position for the next carriage pass. If the driven roll has coasted ahead, by, for example, M increments, where M<N, due to system backlash and load inertia, then the motor will advance M increments until all the backlash has been cleared from the drive train and then both motor and driven roll will advance N−M increments in unison to arrive at the desired park position. In either case, the driven roll ends up at the desired final position without any backlash error contribution.

Embodiments assume that the load will not overshoot the drive train when the drive train makes a series of very short, low velocity increments. In other words, once the backlash has been cleared during the N discrete increments, the load stays in synchronism with the drive train; that is, overshoot errors are negligible because the load is not given sufficient kinetic energy. In embodiments using stepper motors, motor steps can be either accomplished, for example, as full steps, half-steps, and microsteps, depending on the sophistication of the stepper driver circuit.

DETAILED DESCRIPTION

Figure 1:
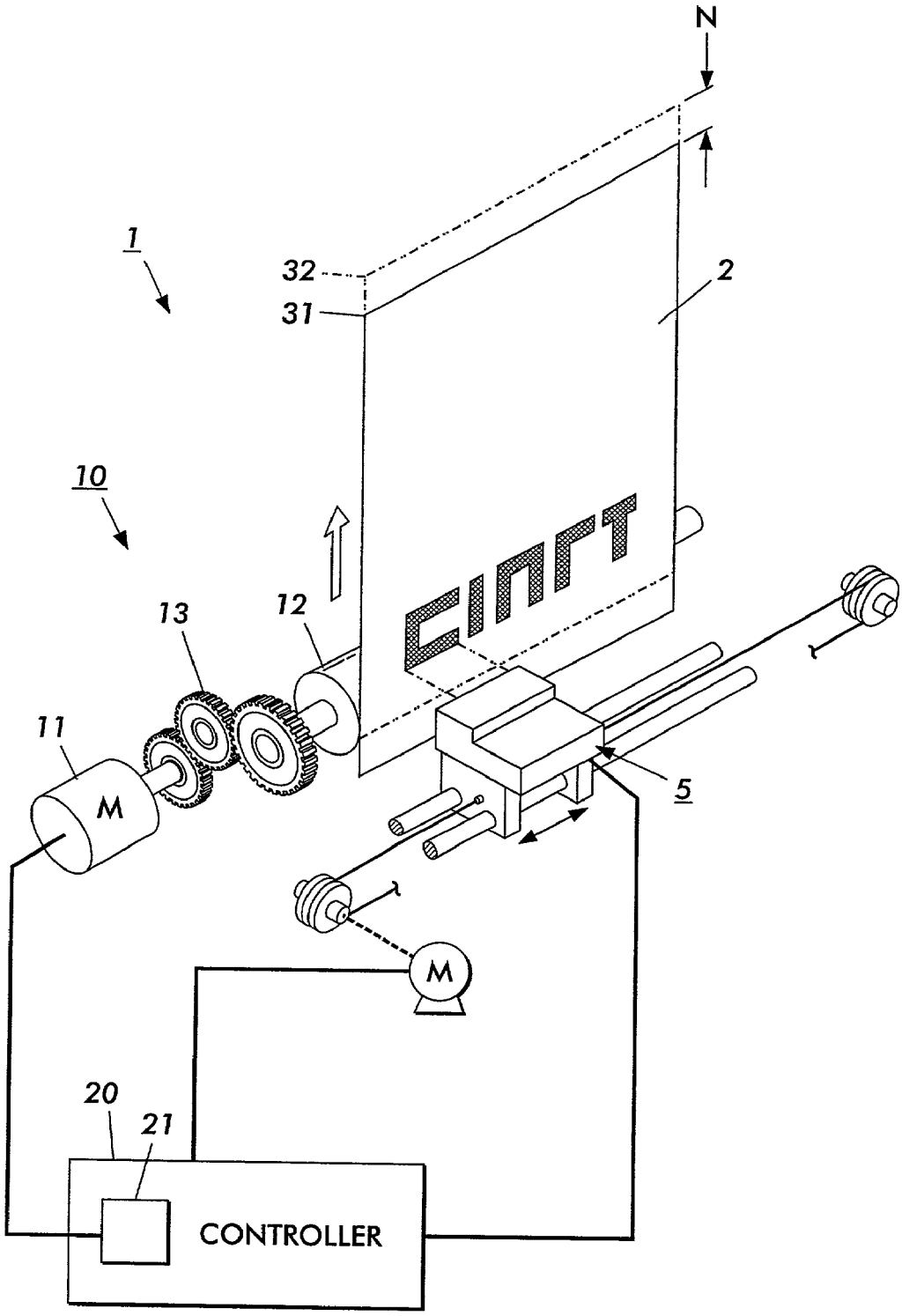
FIG. 1 is a schematic illustrating a printer with a substrate transport system in which embodiments of the invention can be employed.
Figure 2:
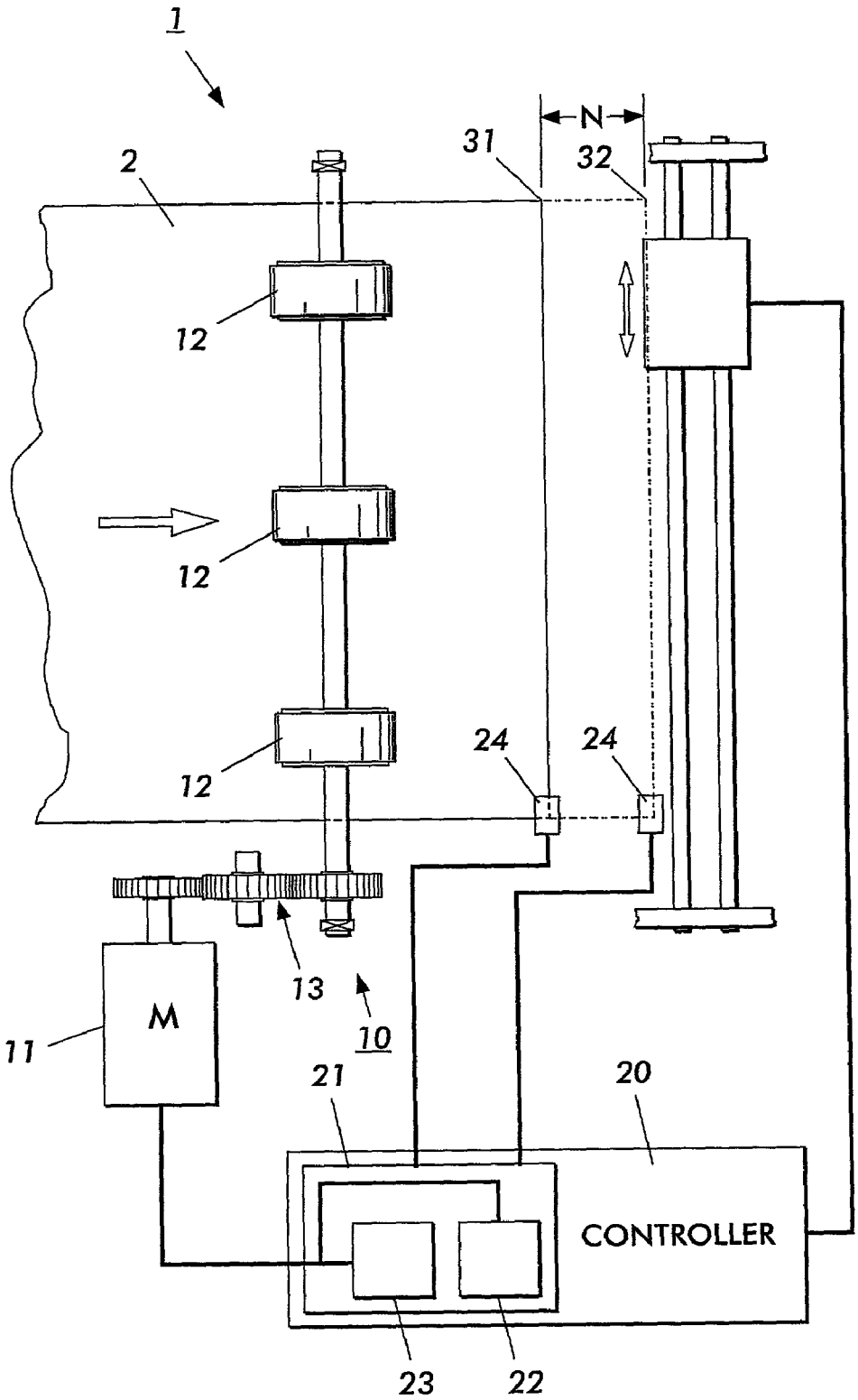
FIG. 2 is a schematic illustrating the components of embodiments of the invention.

While embodiments are described in terms of printers and ink jet printers, it should be readily apparent that embodiments can be applied to other types of machines in which backlash take-up can introduce error into positioning. Thus, the description of the embodiments that follows is exemplary in nature and is not intended to narrow the scope of the claims.

With reference to the accompanying FIGS., a printer 1 arranged to print on a substrate 2, such as paper, includes a substrate transport system 10 including a drive motor 11 and a driven roll 12. Interposed between drive motor 11 and driven roll 12 in embodiments is a gear train 13 or the like that transfers drive from the motor 11 to the roll. As a result of gaps between teeth in the gear train 13, among other things, backlash arises, which can cause errors in substrate placement. The drive motor 11, in embodiments, is a stepper motor driven by a controller 20 that includes a stepper motor drive circuit 21. It should be recognized that a position-controlled servo motor that can be advanced by encoder units could be substituted for the stepper motor; for ease of description, however, a stepper motor will be discussed.

To take up backlash in the transport system 10, embodiments advance the substrate to a point 31 short of an intended final destination 32. For example, embodiments can advance the substrate 2 N motor steps short 31 of a next printing position 32. The distance between the stopping point 31 and the intended final destination 32 can be greater than a total possible backlash error in the drive train 13 between the drive motor 11 and the driven roll 12. Thus, in the example above, the value for N would be greater than the total possible steps the motor 11 would have to make to take up the backlash error in the drive train 13.

At the stopping point 31, the driven roll 12 can be in some indeterminate position within the range of backlash error. The motor 11 then slowly advances the substrate 2 to the intended final destination 32, taking up the backlash in the process. In the example above, the stepper motor 11 makes N additional steps forward to the next printing position 32. If the driven roll 12 has not coasted ahead at all, then it will be advanced by N steps and will be parked in the correct position for the next carriage pass. If the driven roll 12 has coasted ahead, for example, M steps, (where M<N) due to system backlash and load inertia, then the motor 11 will advance M steps until all the backlash has been cleared from the drive train 13. Both motor 11 and driven roll 12 will then advance N−M steps in unison to arrive at the intended final destination 32, the desired park position for the next print. In either case, the substrate 2 and the driven roll 12 ends up at the desired final position 32 without any backlash error contribution.

Embodiments rely on the proposition that the load, i.e., the substrate 2 and driven roll 12, will not overshoot the drive train 13 when the drive train 13 makes a series of very short, low velocity steps. Once the backlash has been cleared during the N discrete steps, the load stays in synchronism with the drive train 13; thus, overshoot errors are negligible because the load never is given sufficient kinetic energy. Where stepper motors are used, motor steps can be either accomplished as full steps, half-steps, or microsteps, depending on the sophistication of the stepper driver circuit 21.

Figure 3:
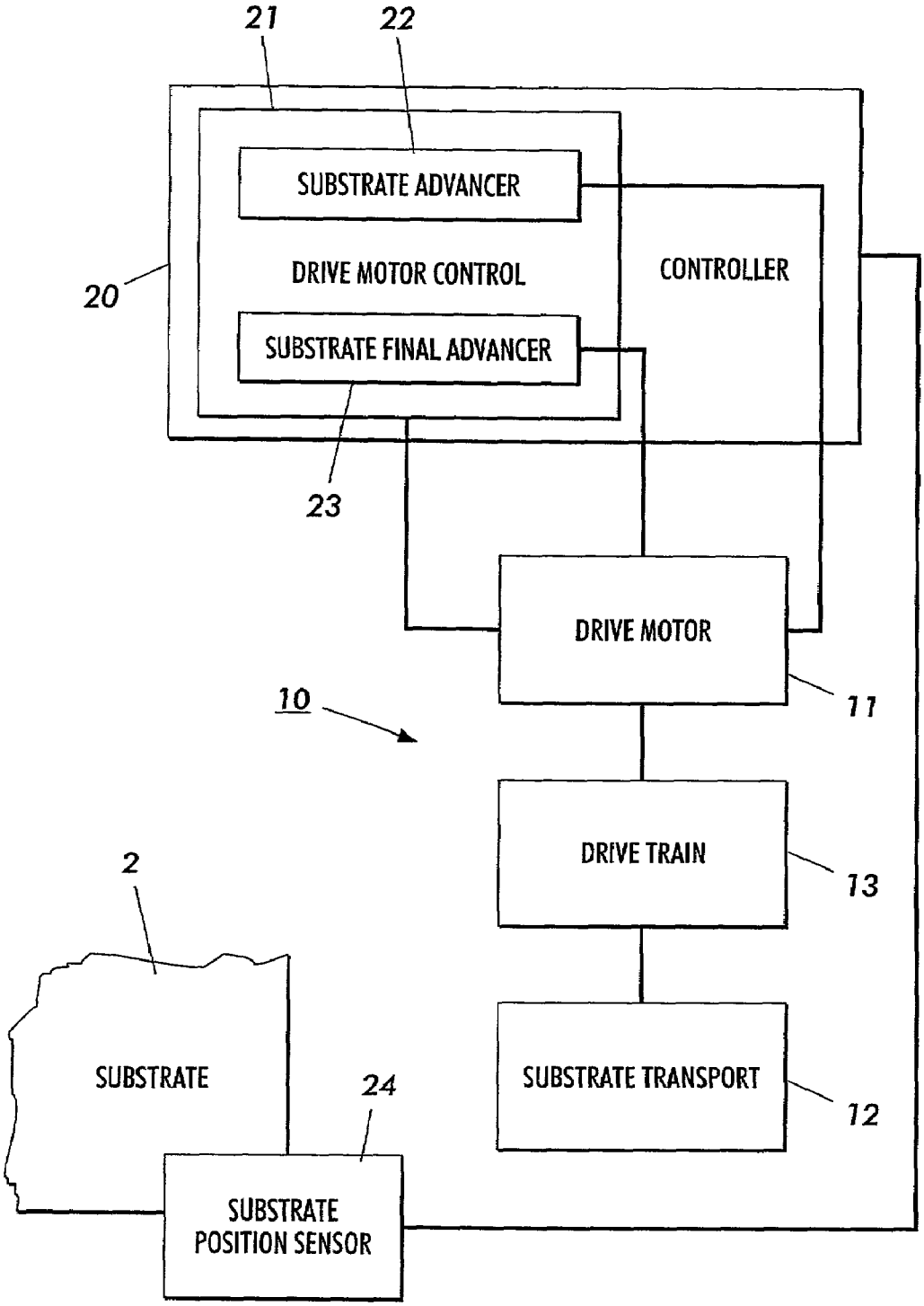
FIG. 3 is a schematic illustrating the components of embodiments of the invention in a more abstract fashion.
Figure 4:
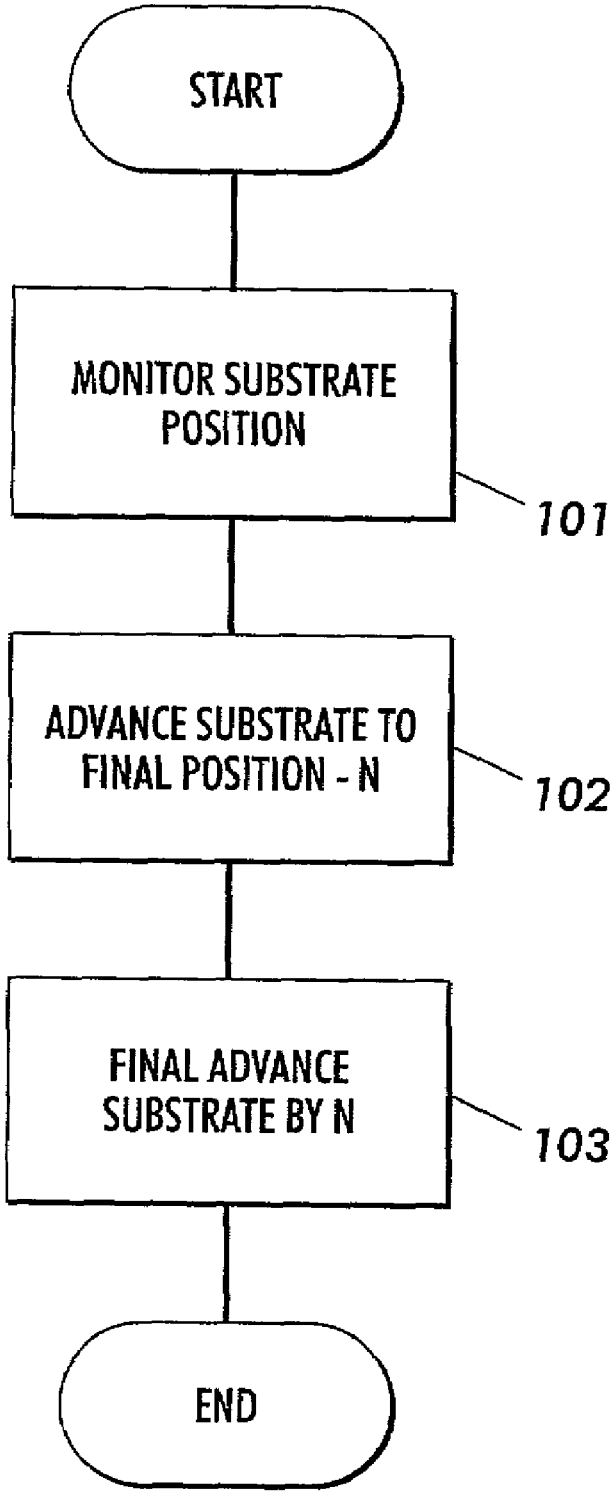
FIG. 4 is a schematic illustrating the method implemented by embodiments of the invention.

In a more abstract explanation, as represented, for example, by schematic FIG. 3, embodiments include a backlash reduction apparatus comprising a drive motor 11, a drive train 13 driven by the motor 11, and at least one substrate transport mechanism 12 connected to the drive train 13 and driven by the motor 11 through the drive train 13. In embodiments, the drive motor 11 is a stepper motor, the drive train 13 is a gear train, and the substrate transport mechanism 12 is at least a driven roller. The apparatus is controlled by a controller 20 comprising a substrate advancer 22 in communication with the stepper motor 11, the substrate advancer 22 emitting control signals to the stepper motor 11 that cause the substrate 2 to move to a point 31 short of an intended destination 32. Embodiments can also include a substrate position sensor 24 to which the substrate advancer 22 can respond, though such position sensors are not necessarily needed.

The controller 20 also includes a substrate final advancer 23 in communication with the stepper motor 11. Embodiments can include one or more substrate position sensors 24 connected to the controller, but such position sensors are not necessarily required. The substrate final advancer 23 sends control signals to the stepper motor 11 that cause the substrate 2 to continue to the intended destination 32. In embodiments, the signals from the substrate advancer 23 cause the stepper motor 11 to stop the substrate 2 a predetermined number of steps, such as N steps, where N is a whole number, from the intended destination 32, the predetermined number of steps being greater than a total possible backlash error in the drive train 13. The substrate final advancer signals then cause the stepper motor 11 to advance by the predetermined number of steps, taking up remaining backlash and moving the substrate 2 to the intended final destination 32 of the substrate (the printing position). The substrate advancer 22 and the final advancer 23 can be responsive to substrate position sensors 24 connected to the controller 20, though such position sensors 24 are not necessarily needed, and can be part of or in communication with a drive motor control circuit 21.

In the abstract or in the concrete, the backlash reduction apparatus will execute a method comprising advancing a substrate to a point short of a final intended position (block 102) and finally advancing the substrate to the final intended position (block 103), thereby taking up backlash in a substrate transport system, as seen, for example, in FIG. 3. The method can also include monitoring substrate position (block 101) and sending substrate position information to a controller that initiates the advancing and final advancing of the substrate, and finally advancing can include advancing the substrate at a lower speed than the speed at which the substrate was advanced to the point short of the final intended destination. Finally advancing can be done by advancing the substrate incrementally from the point short of the final intended destination to the final intended destination, as by providing a stepper motor 11, providing a substrate transport driven by the stepper motor 11.

While the invention has been described with reference to the structures and embodiments disclosed herein, it is not confined to the details set forth, and encompasses such modifications or changes as may come within the purpose of the invention.

What is claimed is:

1. A backlash reduction apparatus comprising:

means for advancing a substrate;

means for stopping advance of the substrate short of a final intended position; and means for finally advancing the substrate.

2. The apparatus of claim 1 wherein the means for stopping operates in response to a means for sensing substrate position.

3. The apparatus of claim 1 wherein the means for finally advancing comprises means for incrementally advancing the substrate.

4. The apparatus of claim 3 wherein the means for incrementally advancing comprises a position-controlled servo motor.

5. The apparatus of claim 3 wherein the means for incrementally advancing comprises a stepper motor.

6. The apparatus of claim 5 wherein the means for finally advancing operates the stepper motor in full steps.

7. The apparatus of claim 5 wherein the means for finally advancing operates the stepper motor in fractions of steps.

8. The apparatus of claim 5 wherein the means for finally advancing operates the stepper motor in microsteps.

9. A backlash reduction method comprising:

advancing a substrate to a point short of a final intended position;

finally advancing the substrate to the final intended position, thereby taking up backlash in a substrate transport system.

10. The method of claim 9 further comprising monitoring substrate position and sending substrate position information to a controller that initiates the advancing and final advancing of the substrate.

11. The method of claim 9 wherein finally advancing includes advancing the substrate at a lower speed than the speed at which the substrate was advanced to the point short of the final intended destination.

12. The method of claim 9 wherein finally advancing includes advancing the substrate incrementally from the point short of the final intended destination to the final intended destination.

13. The method of claim 9 further comprising providing a drive motor, providing a substrate transport driven by the drive motor, and advancing and finally advancing the substrate is achieved by operation of the drive motor and substrate transport.

14. The method of claim 13 wherein providing a drive motor comprises providing a stepper motor and finally advancing the substrate includes operating the stepper motor in full steps.

15. The method of claim 14 wherein finally advancing the substrate includes operating the stepper motor in fractions of steps.

16. The method of claim 14 wherein finally advancing the substrate includes operating the stepper motor in microsteps.

17. A backlash reduction apparatus comprising:

a drive motor operable in increments;

a drive train driven by the drive motor;

at least one substrate transport mechanism connected to the drive train and driven by the drive motor therethrough;

a controller comprising:

a substrate advancer in communication with the drive motor, the substrate advancer emitting control signals to the drive motor that cause the substrate to move to a point short of an intended destination; and a substrate final advancer in communication with the drive motor, the substrate final advancer sending control signals to the drive motor that cause the substrate to continue to the intended destination; and the backlash reduction apparatus advancing a substrate to a point short of a final intended position; and finally advancing the substrate to the final intended position, thereby taking up backlash in a substrate transport system.

* * * * *